US005400724A

United States Patent [19]

Ueda

[11] Patent Number: 5,400,724

[45] Date of Patent: Mar. 28, 1995

[54] PETROLEUM POLYMER PRODUCT TREATMENT APPARATUS

[76] Inventor: Shiyo Ueda, 3-55-50 Yotsuya, Fuchu-shi, Tokyo, Japan

[21] Appl. No.: 151,425

[22] Filed: Nov. 15, 1993

[30] Foreign Application Priority Data

Nov. 16, 1992 [JP] Japan ..... 4-329961
Nov. 8, 1993 [JP] Japan ..... 5-302289

[51] Int. Cl.[6] ..... F23D 14/00

[52] U.S. Cl. ..... 110/235; 201/10; 202/96; 110/248; 110/259; 110/211

[58] Field of Search ..... 110/235, 248, 242, 259, 110/219, 224, 211

[56] References Cited

U.S. PATENT DOCUMENTS 5,213,051 5/1993 Kaneko ..... 110/235
5,287,817 2/1994 Lees, Jr. et al. ..... 110/235

FOREIGN PATENT DOCUMENTS 63-11393 3/1988 Japan .

*Primary Examiner*—Henry C. Yuen

*Attorney, Agent, or Firm*—Nikaido, Marmelstein, Murray & Oram

[57] ABSTRACT

The present invention provides a petroleum polymer product treatment apparatus capable of reducing the thermal energy, which is required to heat the material to be treated, to the smallest possible quantity, effectively utilizing the residue obtained, keeping the heating temperature distribution uniform and setting the heating temperature to a predetermined level, and facilitating this kind of treatment operation while maintaining the safety of a petroleum reduction reproducing operation.

This apparatus is provided with a thermal decomposition unit 50 having a heating furnace 1, an indirect heating means 3 installed in the interior of the heating furnace 1, and a sealed container 4 removably set in the indirect heating means 3; and a residue combustion unit 60 having a combustion furnace 20 adapted to hold the residue 27 left over in the sealed container 4 and burn the same, a means 23 for supplying the air to the combustion furnace 20, and an ignition means 24 for igniting an ignition material 25.

7 Claims, 3 Drawing Sheets

PETROLEUM POLYMER PRODUCT TREATMENT APPARATUS

BACKGROUND OF THE INVENTION

1. Field of the Invention

This invention relates to a petroleum polymer product treatment apparatus, and more particularly to a petroleum polymer product treatment apparatus which is adapted to reproduce an object oil from used petroleum polymer products the typical examples of which include used tires and used plastic products, and from a waste oil, and which is capable of completely turning the residue obtained after such a reproduction operation into ashes.

2. Description of the Prior Art

A method of recyclably discarding used petroleum polymer products the typical examples of which include used tires and used plastic products, and waste oils, without causing environmental pollution to occur has heretofore been studied, and various kinds of methods have been proposed.

The typical example of such methods include a method of reduction reproducing petroleum by, for example, thermally decomposing a product manufactured by polymerizing petroleum, and recycling the reproduced petroleum thus obtained, i.e. a method of heating sand particles in a fluidized bed furnace to a predetermined temperature, and blowing up the sand particles with air of the same temperature so as to mix the sand particles with a material to be thermally decomposed, whereby the material is thermally decomposed.

Such typical methods also include a method of placing a material to be thermally decomposed consisting of a petroleum polymer product in a container, heating the container indirectly or directly so as to reproduce an object oil, and recycling the oil thus obtained.

The method in which a container is heated indirectly is effective, especially, in that the heat can be transmitted uniformly to the container. In this method, various means are employed, for example, the container is doubly formed so as to transmit heat to the inner wall thereof via a space, or the wall of a container is formed to a larger thickness so that the heat can be transmitted thereto uniformly.

However, a thermal decomposition method using a fluidized bed furnace requires a lot of money for the equipment investment, and it is impossible to expect a great effect concerning the thermal decomposition of all kinds of petroleum polymer products (plastic products and tires).

In the thermal decomposition method in which a container is heated directly, it is difficult to maintain a material to be thermally decomposed, within a predetermined range of temperature for a long period of time, so that nonuniformity occurs in the thermal decomposition of the material due to the excessively high or insufficiently low temperature of the material. Consequently, a low-quality oil is mixed in the reproduced oil, and obtaining a high-quality oil becomes difficult. Moreover, this thermal decomposition method does not have safety measures to be taken when leakage occurs in the container.

In all of the thermal decomposition methods in which a container is indirectly heated, a large heat loss occurs when the container is replaced with another, i.e., a great deal of thermal energy is required when the newly installed container is heated, so that these methods are not economical.

In addition, these various kinds of thermal decomposition methods does not have any effective means for disposing the residue, such as carbon occurring when used petroleum polymer products and a waste oil are treated to reproduce an object oil. The expert dealers are invited to recover the residue and discard the same, so that the disposing of the residue also costs much to cause the used petroleum product and waste oil treatment cost to further increase.

SUMMARY OF THE INVENTION

An object of the present invention is to solve these problems, and provide a petroleum polymer product treatment apparatus capable of reducing the thermal energy, which is required to heat the material to be treated, to the smallest possible quantity, effectively utilizing the residue obtained, keeping the heating temperature distribution uniform and setting the heating temperature to a predetermined level, and facilitating this kind of treatment operation while maintaining the safety of a petroleum reduction reproducing operation.

To achieve this object, the present invention provides a petroleum polymer product treatment apparatus comprising a thermal decomposition unit consisting of a heating furnace provided in a lower space thereof with a high-speed jet burner-carrying combustion chamber, and at an upper portion thereof with a combustion gas swirling space, a recessed indirect heating means of a doubly-formed trunk structure having a heat storing heating medium, which is molten at a high temperature and sealed in the interior of a wall of a trunk portion thereof, opposed at the outer circumferential surface thereof to the inner surface of an upper portion of the heating furnace via a predetermined width of clearance, and opposed at the lower surface thereof to the combustion chamber, and a sealed container capable of holding in a sealed state a material to be thermally decomposed, having on a cover member thereof a gas induction pipe for taking out therethrough a thermal decomposition gas generated by the material being thermally decomposed, and capable of being detachably placed in the indirect heating means so that the sealed container is opposed to the inner surface of a recessed portion thereof via a predetermined width of clearance; an oil reducing unit connected to the thermal decomposition unit via the gas induction pipe and having a cooler, an oil-water separator and an oil tank; and a residue combustion unit consisting of a combustion furnace capable of holding residue occurring when the object material is thermally decomposed, and provided with a residue burning ignition material on the bottom surface thereof and a discharge port from which ashes remaining after the combustion of the residue are discharged, a means for supplying the air to the combustion furnace, and an ignition means for igniting the ignition material.

The present invention also provides a petroleum polymer product treatment apparatus according to the above-described apparatus, wherein the combustion furnace is provided therein with a residue supply means capable of supplying the residue at a predetermined rate to the interior thereof continuously.

The present invention further provides a petroleum polymer product treatment apparatus according to the above-described apparatuses, wherein the air supply means is provided with a means for distributing the air uniformly in the interior of the combustion furnace.

The present invention further provides a petroleum polymer product treatment apparatus according to the above-described apparatuses, wherein the apparatus is further provided with a residue takeout means adapted to support the sealed container detached from the indirect heating means, in such a manner that the sealed container can be turned on a horizontal shaft.

The present invention further provides a petroleum polymer product treatment apparatus according to the above-described apparatuses, wherein the apparatus is further provided with means for transmitting the heat generated in the combustion unit to the thermal decomposition unit and a preheating furnace.

The present invention further provides a petroleum polymer product treatment apparatus according to the above-described apparatuses, wherein the apparatus is further provided with a preheating furnace capable of preheating a second sealed container, in which a material in reserve to be thermally decomposed is stored, by utilizing the heat generated in the heating furnace in the thermal decomposition unit.

The present invention further provides a petroleum polymer product treatment apparatus according to the above-described apparatuses, wherein a non-liquefied gas generated in the oil-water separator is drawn out as a heat source for the heating furnace or the preheating furnace.

Since the petroleum polymer product treatment apparatus according to the present invention is provided with a thermal decomposition unit mentioned above, it becomes possible to minimize the thermal energy required to heat a material to be thermally decomposed, set uniform the distribution of the heat applied to the sealed container and set the temperature of the heat to a predetermined level, and obtain a high-quality reproduced oil through a facilitated reducing reproduction operation carried out as the safety of the operation is maintained. The heating medium-sealed indirect heating means is capable of uniformly transmitting the calorific power thereof to the sealed container, in which a material to be thermally decomposed is held, via an air layer at a speed corresponding to a decomposition rate until the temperature of the sealed container has reached a predetermined level. The thermal decomposition of the material is carried out at such a temperature, and a thermal decomposition gas occurring in the decomposition operation is supplied to the oil reducing unit via the gas induction pipe. Thus, an excellent reproduced oil of a predetermined quality can be obtained.

Owing to the excellent heat accumulating characteristics of the heating medium, a heat loss occurring when the sealed container which has finished being subjected to a thermal decomposition operation is replaced by another can be reduced greatly (the degree of reduction of such a heat loss can be increased if a sealed container to be newly used is preheated), and the transmission of heat to the material to be thermally decomposed which is sealed in a container to be subsequently used can be effected immediately. Accordingly, the time required to carry out second and later thermal decomposition operations can be reduced greatly, so that a highly efficient thermal decomposition operation can be carried out. Since a heat loss decreases greatly, the ON-OFF operation of the high-speed jet burner used for heating the indirect heating means in which a heating medium is sealed can be carried out intermittently, and this enables a great energy-saving effect of the apparatus to be displayed.

The heating medium in use consists preferably of salt having as a main component a compound (NaCl, $Na_2CO_3$) of hydroxide (NaOH, KOH) and Na. This salt is solid (massive) at normal temperature and melted at a high temperature of not lower than 250° C., and has excellent heat accumulating characteristics and a high thermal conductivity. For example, 1 $m^3$ of this salt sealed in a square container has the characteristics that, even when it is left as it is in a normal-temperature place for 24 hours after it has been heated to 400° C., the temperature does not substantially drop. Moreover, when 0.15 $m^3$ of this salt sealed in the cylindrical wall of a doubly formed recessed container like the indirect heating means in the present invention with a sealed container, in which a material to be thermally decomposed is inserted, placed in the recessed portion of this doubly formed container is heated to 400° C. and left as it is, the thickness of the salt and the radiating surface area (heat exchanging surface area) increase about 2.5 times as compared with those in the case where the previously-mentioned square container is used. Therefore, although the modes in which the temperature of the salt drops differ depending upon the surrounding condition, the heat accumulating characteristics that 280° C. can be maintained even when 12 hours have elapsed after the salt was heated and left as it was in a place mentioned above. Therefore, when the salt-sealed indirect heating means is used at a temperature in the range of 250°-600° C., the calorific power thereof can be transmitted uniformly to the sealed container, in which a material to be thermally decomposed is inserted, via an air layer at a speed corresponding to the decomposition rate until the temperature of the sealed container has reached a predetermined level.

Since the petroleum polymer treatment apparatus according to the present invention is provided with a residue combustion unit, the residue occurring when an object material is thermally decomposed can be burnt to ashes. Accordingly, the residue can be utilized effectively for various kinds of purposes. When the ignition material is ignited by an ignition means in the combustion furnace in which the ignition material is provided, the residue sent thereto can be burnt. Since the air is supplied from the air supply means to the interior of the combustion furnace during this time, the residue can be burnt with a high efficiency. The ashes obtained after the combustion of the residue is finished can be discharged simply from the discharge port to the outside.

Since the residue supply means capable of supplying the residue continuously at a predetermined rate is provided in the combustion furnace, a large quantity of residue is not supplied at a time to the combustion furnace. This enables the residue to be burnt to ashes efficiently without putting an operational burden on the ignition material.

Since the air supply means is provided with a means for distributing the air uniformly into the combustion furnace, the air can be supplied uniformly to the ignition material and residue. Accordingly the residue can be burnt to ashes with an increased efficiency.

A residue takeout means supporting the sealed container (in which the thermal decomposition of an object material has been completed) detached from the indirect heating means, in such a manner that the sealed container can be turned on a horizontal shaft is also provided. Therefore, the residue in the sealed container can be supplied simply into the combustion furnace by simply inclining the upper portion of the former downward, so that the operation efficiency can be improved.

Moreover, since a preheater capable of preheating the second sealed container in which a material to be thermally decomposed is held in reserve, by utilizing the heat occurring in the heating furnace in the thermal decomposition unit is provided, the sealed container standing by for being subsequently subjected to a thermal decomposition operation can be preheated. Therefore, the quantity of heat required to carry out a second and later thermal decomposition operation can be reduced, so that the cost of energy required to thermally decompose an object material can be reduced to a great extent. The partial thermal decomposition of an object material is started in the second sealed container. Consequently, if the second sealed container is connected to the oil reducing unit so that a thermal decomposition gas occurring in the former is supplied to the latter through the gas induction pipe, a thermal decomposition operation can be carried out with an increased efficiency.

This apparatus is further provided with a heat transmission means for selectively transmitting the heat generated in the residue combustion unit to the heating furnace and preheating furnace. Accordingly, the heat occurring during the combustion of the residue can be utilized for the thermal decomposition of an object material. This enables the quantity of heat required to thermally decompose the object material to be reduced, and the cost of energy required for the same purpose to be cut off greatly. In addition, the preheating furnace can be utilized also as a heating furnace.

The non-liquefied gas occurring in the oil-water separator can be utilized for the thermal decomposition of the object material by inducing the same gas as a heat source for the heating furnace. This also enables the quantity of heat required to thermally decompose the object material to be reduced, and the cost of energy required for the same purpose to be cut off greatly.

The above and other objects as well as advantageous features of the invention will become apparent from the following description of the preferred embodiment taken in conjunction with the accompanying drawings.

DESCRIPTION OF THE PREFERRED EMBODIMENT

An embodiment of the present invention will now be described with reference to the drawings.

Figure 1:
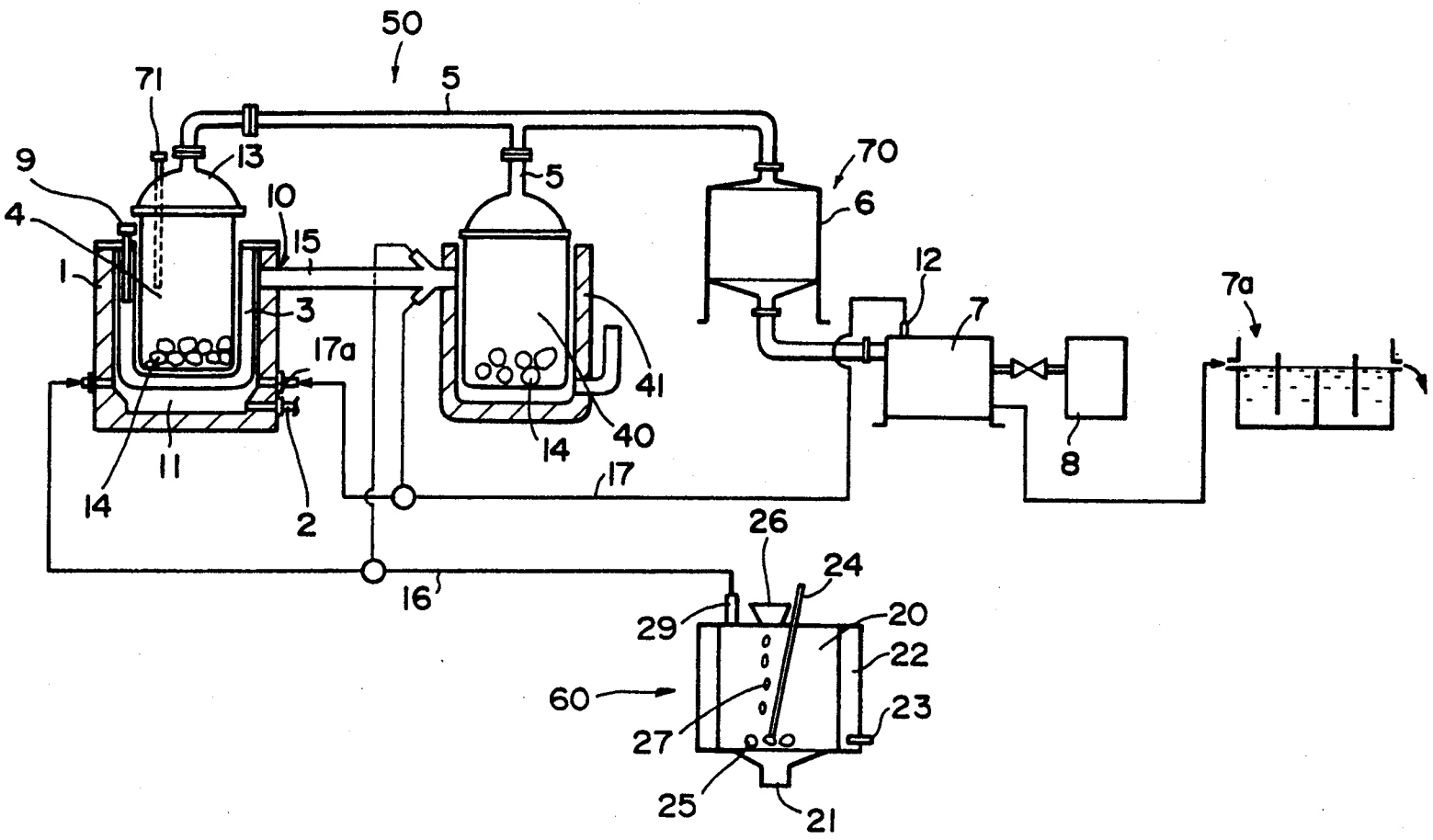
FIG. 1 is a construction diagram of an embodiment of the petroleum polymer product treatment apparatus according to the present invention.
Figure 2:
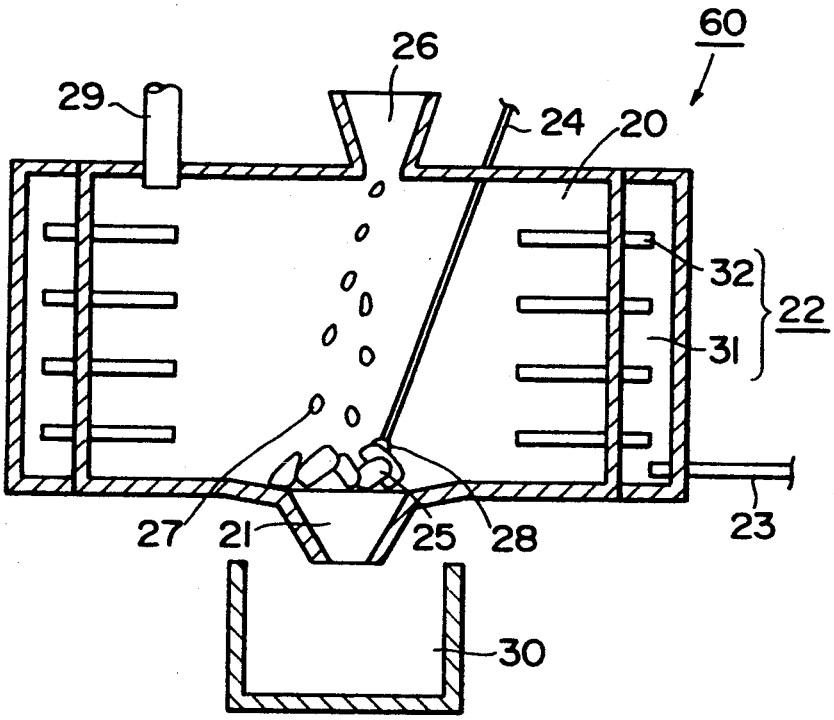
FIG. 2 is an enlarged view of a residue combustion unit shown in FIG. 1.
Figure 3:
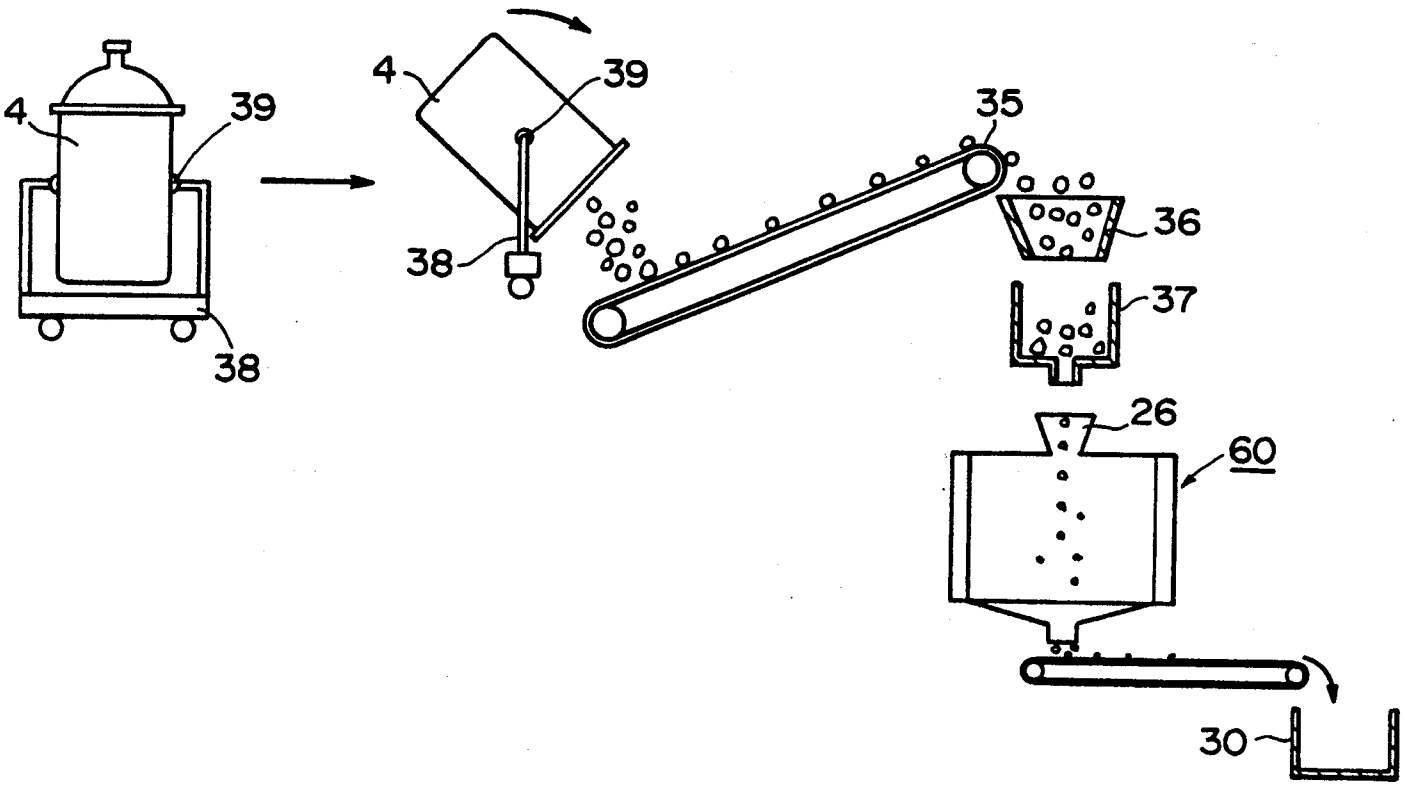
FIG. 3 illustrates the step of supplying the residue in a sealed container, which is detached from an indirect heating means after the thermal decomposition of an object material in the petroleum polymer product treatment apparatus of FIG. 1 has been completed, to a combustion furnace in a residue combustion unit.

FIG. 1 is a construction diagram of an embodiment of an embodiment of the petroleum polymer product treatment apparatus according to the present invention, FIG. 2 an enlarged view of a residue combustion unit shown in FIG. 1, and 3 a diagram illustrating the step of supplying the residue in a sealed container, which is detached from an indirect heating means after the thermal decomposition of an object material has been completed, to a combustion furnace in a residue combustion unit.

As shown in FIGS. 1–3, the petroleum polymer product treatment apparatus of this embodiment consists of a thermal decomposition unit 50, a residue combustion unit 60 and an oil reducing unit 70.

The thermal decomposition unit 50 has a heating furnace 1 having in the lower space thereof a combustion chamber 11 using a high-speed jet burner 2 therein, and in the upper portion thereof a combustion gas turning space, as shown in FIG. 1. A doubly formed recessed indirect heating means 3 is provided in the heating furnace 1 so that the outer circumferencial surface of the former is opposed to the inner surface of an upper portion of the latter via a predetermined width of clearance with the lower surface of the indirect heating means 3 facing the combustion chamber 11.

A heat-storing heating medium which is molten at a high temperature is sealed in the wall of a trunk portion of the indirect heating means 3. A thermocouple 9 which will be described later is also sealed in the wall of the indirect heating means 3. The indirect heating means 3 is so formed that a material 14 to be thermally decomposed, such as a used tire can be held in a sealed state on the inner side of a recessed portion thereof. A sealed container 4 provided on its cover member 13 with a gas induction pipe 5 for taking out a thermal decomposition gas generated by the material 14 is placed detachably in the recessed portion of the indirect heating means 3 with a clearance of a predetermined width left between the sealed container and the inner surface of the recessed portion.

In order that the clearance between the sealed container 4 and indirect heating means 3 works as an air layer, various kinds of means (flange in this embodiment) for fixing the cover member 13 of the sealed container 4 are provided on the same cover member, i.e., consideration is given so as to prevent the heat from escaping. This clearance preferably consists of a space of a required minimum volume for enabling the sealed container 4 to be inserted and removed into and from the recessed portion of the heating means 3.

Since the high-speed jet burner 2 is used, the heating furnace 1 can be formed so as to have a compact furnace body, and a complete combustion gas flows to a gas discharge port 10 of the heating furnace 1, so that the lower surface and the whole of the outer circumferential surface of the in direct heating means can be heated uniformly. During this time, the quantity of thermal energy per unit area applied to each portion of the indirect heating means 3 scatters but the thermal energy applied to the indirect heating means 3 is first accumulated as latent heat in the heating medium, and radiated to the inner surface of the indirect heating means 3 after the thermal energy has become uniform in the heating medium. Accordingly, the thermal energy is finally transmitted as heating energy of uniform heat distribution to the sealed container 4. Therefore, the temperature of the heating medium in the indirect heating means 3 quickly reaches a predetermined level (in a period of time which is around ½ of a corresponding period of time in a case where the lower surface portion only of the indirect heating means is heated). This heating medium in a solid state is melted when the temperature thereof has increased to 250° C.

The thermocouple 9 sealed in the indirect heating means 3 is adapted to control the temperature of the heating medium to not higher than 550° C., and enables the temperature of the material 14 to be decomposed to be kept at around 320° C., an optimum level for the reproduction of oil. During this step, the material 14 to be decomposed turns into liquid at around 170° C., and generates a reproduced oil-containing gas of a uniform quality when the material 14 maintains a temperature of 320° C. on an average continuously, this gas flowing through the gas induction pipe 5 and reaching a cooler 6 which will be described later.

In a position adjacent to that of the thermal decomposition unit 50, a preheating furnace 41 capable of preheating a second sealed container 40 in which a material 14 to be subsequently thermally decomposed is held is provided. Between the preheating furnace 41 and thermal decomposition unit 50, a heat transmission means 15 for transmitting the heat generated in the heating furnace in the thermal decomposition unit 50 to the second sealed container 40 is provided. Preheating this second sealed container 40 by the heat transmission means 15 enables the cost of energy required to thermally decompose the material therein to be reduced to a great extent. Since a gas induction pipe 5 provided on the second sealed container 40 is also connected to the cooler 6, a thermal decomposition gas occurring during a preheating operation also reaches the cooler 6.

A burner 17*a* for burning a non-liquefied gas generated in an oil-water separator 7, which will be described later, an induction means 17 for guiding the gas to the burner 17*a*, and a heat transmission means 16 for transmitting the heat occurring in a residue combustion unit 60, which will be described later, to the thermal decomposition unit 50 are connected to the thermal decomposition unit 50.

The gas induction pipe 5 is connected to the cooler 6 in the oil reducing unit 70. The oil reducing unit 70 consists of the cooler 6 adapted to cool the thermal decomposition gas supplied from the gas induction pipe 5 thereto and decompose this gas into oil, water and a non-liquefied gas, an oil-water separator 7 for separating the oil, water and non-liquefied gas, which are obtained (decomposed) in the cooler 6, from one another, and an oil tank 8 for holding (recovering) the oil obtained in the oil-water separator 7.

A non-liquefied gas discharge port 12 provided at the upper portion of the oil-water separator 7 is connected to the burner 17*a*, which is provided in the heating furnace 1 in the thermal decomposition unit 50, via the induction means 17, so that the non-liquefied gas can be utilized as a calorific power source required when the material 14 held in the sealed container 4 is thermally decomposed, this enabling the cost of energy required for a thermal decomposition operation to be reduced greatly. The non-liquefied gas can also be utilized as a heat source for the preheating furnace 41 for the second scaled container 40, though the details are not illustrated.

The residue combustion unit 60 constituting a part of the petroleum polymer product treatment apparatus according to this embodiment has, as shown in, especially, FIG. 2, a residue combustion furnace 20 capable of holding residue 27 occurring in the sealed container 4 when the material 14 is thermally decomposed in the thermal decomposition unit 50; provided on the bottom surface thereof with an ignition material 25 for burning the residue 27; and provided in a bottom wall thereof with a discharge port 21 for discharging therefrom the ashes occurring after the residue has been burnt.

The residue combustion furnace 20 is provided at its outer circumferential portion with an air distributing means 22 consisting of an air storage chamber 31 adapted to temporarily store the air supplied from the air supply means 23, and a plurality of air supply pipes 32 through which the air in the air storage chamber 31 is supplied to the combustion furnace 20. Owing to the provision of the air storage chamber 31 and air supply piped 32, the air can be supplied to the interior of the combustion furnace 20 uniformly.

The residue combustion furnace 20 is provided at its upper portion with a residue supply means 26 capable of supplying the residue 27, which is fed from the sealed container 4, to the combustion furnace 20 continuously at a predetermined rate. The combustion furnace 20 is also provided at its upper portion with a gas discharge port 29 from which a gas occurring therein is discharged. This gas discharge port 29 is connected to the thermal decomposition unit 50 via the heat transmission means 16 as mentioned above. Since the heat generated during the combustion of the residue 27 can be utilizer for the thermal decomposition of the object material 14 owing to this heat transmission means 16, the quantity of heat required for the thermal decomposition of the material 14 can be reduced, and the cost of energy required for the same purpose can be cut off greatly.

The residue combustion unit 60 is provided with an ignition means for igniting the ignition material 25 in the combustion furnace 20. The discharge port 21 is formed so that it is opened when the combustion of the residue 27 has been completed. A vessel 30 for recovering the ashes discharged from the discharge port 21 is provided below the same discharge port 21.

The operation of the petroleum polymer product treatment apparatus according to this embodiment will now be described with reference to the drawings.

First, a used petroleum polymer product, such as a used tire is sealed in the container 4, which is then sealed and inserted in the indirect heating means 3. A heating medium having the components and characteristics shown in the following Table 1 is sealed in the wall of a trunk portion of the indirect heating means 3, which is then heated at a temperature in tho range of 250°–450° C.

TABLE 1

| | | |
|---|---|---|
| Component | NaOH<br>KOH | Not less than 70% |
| | NaCl<br>$Na_2CO_3$<br>etc. | Rest |
| Property | Neutral salt solution | |
| Salting-in composition | Single salt | |
| Shape of product | Massive, Light blue-white | |
| Specific gravity | 1.9/380° C., 1.8/500° C. | |
| Range of use | 250°–700° C. | |

The heating medium-sealed indirect heating means 3 is adapted to transmit the calorific power thereof to the sealed container 4 via the air layer mentioned above, and heat the sealed container 4 uniformly at a rate corresponding to the decomposition rate until the temperature of the container 4 has reached a predetermined level. The thermal decomposition of the material 14 held in the sealed container 4 is carried out with the heat thus transmitted thereto. The thermal decomposition gas occurring due to the thermal decomposition of the material 14 is supplied from the gas induction pipe 5 to the cooler 6, and then to the oil-water separator 7.

The heat of the heating furnace by which the indirect heating means 3 is heated is transmitted to the second sealed container 40 standing by for being subjected to a subsequent thermal decomposition operation, via the heat transmission means 15. The second sealed container 40 is preheated with this heat. The thermal decomposition gas occurring during this preheating operation is supplied to the cooler through the gas induction pipe 5.

The decomposition gas supplied to the oil-water separator 7 is separated therein into oil, water and a non-liquefied gas. The oil is recovered by the oil tank 8, the water discharged via a oil-water separating tank 7*a*, and the non-liquefied gas utilized as a fuel for the heating furnace 1 in the thermal decomposition unit 50 through the induction means 17 and burner 17*a* and as the thermal decomposition energy in the thermal decomposition unit 50. The oil recovered by the oil tank 8 is reused therein as a reproduced oil.

The sealed container 4 in which a decomposition operation (reducing reproduction operation) has finished is removed from the indirect heating means 3 by a suitable means, and transferred to the residue takeout means 38. This residue takeout means 38 is provided as shown in FIG. 3 with a rotary means 39 capable of supporting the sealed container 4 so that the sealed container 4 can be turned on a horizontal shaft.

At the same time, the second sealed container 40 which has been preheated is set in the indirect heating means 3. Even when an operation for exchanging the sealed container 4 with the second sealed container 40 is a little prolonged, a decrease in the temperature of the indirect heating means 3 can be prevented owing to the heat accumulating effect of the heating medium, so that the thermal energy required for a subsequent thermal decomposition operation can be noticeably saved. Since the second sealed container 40 is heated in advance, a thermal decomposition operation can be finished in a period of time shorter than that in a case where a sealed container not preheated at all is used.

As described in the above statement about the property of the heating medium, it has excellent heat accumulating characteristics, and does not substantially radiate heat to no purpose. Accordingly, if a plurality of sealed containers are prepared, the operation efficiency can be improved. This property of the heating medium can also be utilized in an apparatus and a method in which the heating medium is heated to a predetermined temperature, and in which the heat thus generated is utilized for a long period of time. If the heating medium is heated to a predetermined temperature, the consumption of the fuel becomes very small owing to this property thereof and because the calorific power required by the material 14 to be thermally decomposed is transmitted thereto at a rate corresponding to the decomposition rate, though the ON-OFF operations for the high-speed jet burner 2 are carried out repeatedly by the thermocouples 71, 9.

The residue takeout means 38 is adapted to transfer the sealed container 4 supported thereon to the place where a belt conveyor 35 for supplying the residue 27 to the residue combustion unit 60 is provided, operate the rotary means 39 in this place so that the sealed container 4 is inclined until the upper portion thereof is positioned on the lower side, and place the residue 27 in the sealed container 4 on the belt conveyor 35. In order to carry out this transfer operation smoothly, moving means, such as castors are provided on the lower portion of the residue takeout means 38.

The residue 27 thus placed on the belt of the belt conveyor 35 is carried to a hopper 36 into which the residue is to be inserted, and, after the residue 27 has dropped into the hopper 36, it reaches a residue feed rate regulator 37. The residue is then supplied at a predetermined flow rate to the combustion furnace 20 in the residue combustion unit 60 via the residue supply means 26.

The residue 27 supplied to the interior of the combustion furnace 20 ignites by the ignition material 25 and is heated through the air supply means 23 and air storage chamber 31, the residue 27 being burnt with the heated air, which is supplied in a distributed manner from a plurality of air supply pipes 32, to ashes. The combustion gas occurring during this time is utilized as a fuel for the heating furnace 1 in the thermal decomposition unit 50 through the gas discharge port 29 and heat transmission means 16. If a jacket is provided (not illustrated), hot water is obtained, which can be utilized for various purposes.

The ashes and iron wire thus obtained are recovered from the discharge port 21 by the ash recovering vessel 30 via an electromagnetic means, and then utilized for various purposes. The iron wires can be recovered by the electromagnetic means.

Although the petroleum polymer product treatment apparatus according to this embodiment has been described with reference to a case where the sealed container 4 and second sealed container 40 are provided, the apparatus is not limited to this case, i.e., the number of the sealed containers to be installed may be arbitrarily determined.

The above embodiment has been described with reference to a case where one residue combustion unit 60 is employed but the embodiment is not limited to this case, i.e., the number of the residue combustion unit to be installed may be arbitrarily determined.

The petroleum polymer product treatment apparatus according to the present invention can be utilized for a reproduction treatment for all kinds of petroleum polymer products, such as used tires and used plastic products, and waste oils.

1100 kg of used tires for regular passenger cars and 1100 kg of used paint were inserted as materials to be thermally decomposed in the sealed container in the petroleum polymer product treatment apparatus according to the present invention, and a reducing reproduction treatment therefor was carried out. Consequently, 1040 kg of reproduced oil, 68 $m^3$ of a non-liquefied gas and 60 kg of water were obtained. The weight of the residue (carbons) obtained at the same time was 680 kg, which was burnt in the residue combustion unit 60 to obtain 594 kg of ashes.

Thus, the petroleum polymer product treatment apparatus according to the present invention is capable of efficiently carrying out a recycling treatment for used petroleum polymer products and waste oils. Moreover, it enables not only the reutilization of the reproduced oil but also the utilization of the nor-liquefied gas, which occurs during the recycling treatment, as a fuel, the combustion of the residue (carbons) occurring during the thermal decomposition of the object materials, the reutilization of the heat occurring during the combustion of the residue, the reutilization of the iron wires, and the recovering of the ashes, which are left over after the combustion of the residue, as a fertilizer and a material for concrete briquettes. The present invention thus contributes greatly to the reutilization of resources.

Since the petroleum polymer product treatment apparatus according to the present invention is provided with a thermal decomposition unit and a residue combustion unit as described above, it is capable of minimizing the thermal energy required to heat a material to be thermally decomposed, setting the distribution of heating temperature uniformly and the heating temperature at a predetermined level, obtaining a reproduced oil of a high quality in an operation-facilitated condition with the safety of a reducing reproduction operation maintained, and reutilizing the residue, which is obtained after the thermal decomposition operation has been completed, by burning the same to ashes. This enables used petroleum polymer products to be discarded simply at a low cost, and the resources to be reutilized.

Since a means capable of supplying residue continuously at a predetermined rate is provided on the combustion furnace, the residue is not supplied at a high rate at a time to the interior of the combustion furnace. Owing to this advantage in addition to the above-mentioned effect, the residue can be burnt to ashes efficiently without putting a burden on the ignition material.

Since the air supply means is provided with a means for distributing the air uniformly into the combustion furnace, the air can be supplied uniformly to the ignition material and residue. Accordingly, owing to this advantage in addition to the above-mentioned effects, the residue can be burnt to ashes efficiently, and iron wires can be separated by an electromagnetic means.

Since a sealed container support means for supporting the sealed container, which is removed from the indirect heating means, in such a manner that the sealed container can be turned on a horizontal shaft is provided, the upper portion of the sealed container can be inclined simply to the lower side. Therefore, owing to this advantage in addition to the above-mentioned effects, the residue left over in the sealed container in which the thermal decomposition of the object material has been finished can be supplied to the combustion furnace simply, and the operation efficiency can be improved.

Since a means for transmitting the heat, which occurs in the residue combustion unit, to the thermal decomposition unit is provided, the heat occurring during the combustion of the residue can be utilized for the thermal decomposition of the object material. Accordingly, owing to this advantage in addition to the above-mentioned effects, the quantity of heat required to thermally decompose the object material can be reduced, and the cost of energy required for the thermal decomposition operation can further be cut off.

A preheating furnace for the second sealed container is provided. This enables the quantity of heat required to thermally decompose the object material in the second sealed container, which stands by for being subjected to a subsequent thermal decomposition operation, to be reduced, and the cost of energy required for the thermal decomposition operation to be further cut off.

The non-liquefied gas occurring in the oil-water separator can be utilized as one of the heat sources for the heating furnace or the preheating furnace, i.e., for the thermal decomposition of the object material therein. Therefore, owing to this advantage in addition to the above-mentioned effects, the quantity of heat required to thermally decompose the object material can be reduced, and the cost of energy required for the thermal decomposition operation can further be cut off.

The present invention is not, of course, limited to the above-described embodiment; it may be modified in various ways within the scope of the appended claims.

What is claimed is:

1. A petroleum polymer product treatment apparatus comprising:

a thermal decomposition unit consisting of a heating furnace provided in a lower space thereof with a high speed jet burner-carrying combustion chamber, and at an upper portion thereof with a combustion gas swirling space, a recessed indirect heating means of a doubly-formed trunk structure having a heat-storing heating medium, which is molten at a high temperature and sealed in the interior of the wall of a trunk portion thereof, opposed at the outer circumferential surface thereof to the inner surface of an upper portion of said heating furnace via a predetermined width of clearance, and opposed at the lower surface thereof to said combustion chamber, and a sealed container capable of holding in a sealed state a material to be thermally decomposed, having on a cover member thereof a gas induction pipe for taking out therethrough a thermal decomposition gas generated by said material being thermally decomposed, and capable of being detachably placed in said indirect heating means so that said sealed container is opposed to the inner surface of a recessed portion thereof via a predetermined width of clearance, an oil reducing unit connected to said thermal decomposition unit via said gas induction pipe and having a cooler, an oil-water separator and an oil tank, and a residue combustion unit consisting of a combustion furnace capable of holding residue occurring when said object material is thermally decomposed, and provided with a residue burning ignition material on the bottom surface thereof, a gas discharge port which communicates with said thermal decomposition unit and a discharge port from which ashes remaining after the combustion of the residue are discharged, a means for supplying the air to said combustion furnace, and an ignition means for igniting said ignition material.

2. A petroleum polymer product treatment apparatus according to claim 1, wherein said combustion furnace is provided therein with a residue supply means capable of supplying said residue at a predetermined rate to the interior thereof continuously.

3. A petroleum polymer product treatment apparatus according to claim 1, wherein said means for supplying air is provided with a means for distributing the air uniformly in the interior of said combustion furnace.

4. A petroleum polymer product treatment apparatus according to claim 1, wherein said apparatus is further provided with a residue takeout means adapted to support said sealed container detached from said indirect heating means, said sealed container being rotatably positioned on a horizontal shaft.

5. A petroleum polymer product treatment apparatus according to claim 1, wherein said apparatus is further provided with a preheating furnace capable of preheating a second sealed container, in which a material in reserve to be thermally decomposed is stored, by utilizing the heat generated in said heating furnace in said thermal decomposition unit.

6. A petroleum polymer product treatment apparatus according to claims 5, wherein said apparatus is further provided with means for transmitting the heat generated in said combustion unit to said heating furnace and said preheating furnace selectively.

7. A petroleum polymer product treatment apparatus according to claim 5, wherein a non-liquefied gas generated in said oil-water separator is capable of being drawn out as a heat source for said heating furnace and said preheating furnace.

* * * * *